US005647586A

United States Patent [19]

Novick et al.

[11] Patent Number: 5,647,586

[45] Date of Patent: Jul. 15, 1997

[54] METHOD AND APPARATUS FOR DECELERATING A FLAT PRODUCT

[75] Inventors: Michael A. Novick, New Durham; Charles H. Dufour, Durham, both of N.H.

[73] Assignees: Heidelberg Harris Inc., Dover, N.H.; Heidelberger Druckmaschinen AG, Heidelberg, Germany

[21] Appl. No.: 570,432

[22] Filed: Dec. 11, 1995

[51] Int. Cl.[6] ..... B65H 29/68; B65H 29/20

[52] U.S. Cl. ..... 271/182; 271/187; 271/315

[58] Field of Search ..... 271/187, 315, 271/182, 229

[56] References Cited

U.S. PATENT DOCUMENTS

| | | | |
|---|---|---|---|
| 2,014,933 | 9/1935 | Harless et al. | 271/315 |
| 3,162,438 | 12/1964 | Perry, Jr. . | |
| 4,357,126 | 11/1982 | Kidd et al. | 271/315 |
| 4,600,186 | 7/1986 | Hein et al. | 271/182 |
| 4,834,361 | 5/1989 | Fenske et al. . | |
| 4,886,264 | 12/1989 | Haensch . | |
| 4,971,303 | 11/1990 | Lange et al. . | |

FOREIGN PATENT DOCUMENTS

| | | | |
|---|---|---|---|
| 0407763 | 1/1991 | European Pat. Off. | 271/315 |

*Primary Examiner*—H. Grant Skaggs

*Attorney, Agent, or Firm*—Burns, Doane, Swecker & Mathis, LLP

[57] ABSTRACT

A device for delivering flat products, such as signatures or the like, having a plurality of fan wheels rotatably mounted on a fan wheel shaft. The fan wheels each have a plurality of fan pockets for receiving signatures emerging from a transporting device, the fan wheels being mounted on the fan wheel shaft in spaced relation to one another in an axial direction. Adjustably mounted deceleration devices, each having a curvature for diving between the spaced-apart fan wheels, allow for a desired deceleration of the signatures upon rotation of the fan wheels.

19 Claims, 2 Drawing Sheets

METHOD AND APPARATUS FOR DECELERATING A FLAT PRODUCT

BACKGROUND OF THE INVENTION

1. Field of the Invention

The present invention concerns a signature deceleration device for delivery units which deliver flat products, such as a folding apparatus or the like.

2. Description of Related Art

U.S. Pat. No. 3,162,438 discloses a high-speed document stacking system. A pair of discs, each having a plurality of arcuate slots, is mounted on a common axis of rotation with the pairs of said slots being in alignment. A pair of conveyor belts terminate within a perimeter of said discs for delivering documents into the slots. A pair of guides are arranged between the discs for guiding the documents into the slots and a pair of stripper bars extend between the discs to the region of the inner extremities of the slots. The stripper bars will strip the documents from the slots in the discs.

U.S. Pat. No. 4,834,361 discloses a vane wheel as a lay-out device for printed products. The vane wheel device comprises a vane wheel including a shaft and a plurality of thin vane star discs fixedly mounted on the shaft in a lamellar fashion at a distance from one another. A band supply unit is associated with the vane wheel for supplying printed products to the latter, and a plurality of stationary blowing air nozzles are provided, each associated with a respective one of the vane star discs of the vane wheel. The direction and intensity of a blowing air stream from the blowing air nozzles influences the friction between the printing product falling into one vane and an outer side of another vane which is arranged behind the one vane. The vane star discs, the band supply unit and the blowing air nozzles are arranged in their positions relative to one another, so that the printing product, before its rear edge is ejected from the band supply unit, is blockable by the one vane which receives the printing product from the blowing air stream of the blowing air nozzles. While the printed product's rear edge is ejected, approximately one half of its length is received in the one vane and after ejection of its rear edge, it is braked by the streams of blowing air from the blowing air nozzles. A stripper associated with the vane star discs of the vane wheel and formed as a rack being adjustably mounted is engageable in intermediate spaces between the vane star discs. Through a pressure-air conduit, pressure is supplied to the blowing air nozzles, the pressure being controllable in dependence of a respective machine speed. The vane star discs have a shape which is optimal for braking during receiving the printed products in the vane star discs and for acceleration of the printed product during stripping-off by the stripper.

U.S. Pat. No. 4,886,264 discloses a method and an apparatus for receiving printed products from a rotary driven bucket wheel of a printing press. An outfeed conveyor is arranged beneath a rotary bucket wheel driven to rotate in a predetermined rotational direction. A belt conveyor is arranged downstream and a product entrainment arrangement is arranged upstream of the outfeed conveyor. An endless revolving belt is guided around belt rolls of the outfeed conveyor, and the printed products come to lie thereon in an imbricated formation. Entrainment elements of the product entrainment arrangement stuff the printed products completely into the pockets of a bucket wheel. Upon ejection of the printed products out of the bucket wheel, they are fixedly clamped at their trailing edges between a support element and extensions or cantilever arms of the entrainment elements, until the entrainment elements have passed the support element and thus, an intersection location between the entrainment elements and the support element. The resiliently arranged extensions of the entrainment elements are pivoted by the support element in a predetermined direction, such as clockwise, so that the printed products are cyclically released. There is thus formed an imbricated formation of printed products within which all printed products are aligned, and there can be maintained a substantially constant mutual spacing between the individual products.

U.S. Pat. No. 4,971,303 shows a paddle wheel distributor system for printed products. In order to provide for gentle braking by braking fingers located in axial slots between paddle wheel vanes or blades of paddle wheels, the braking fingers have an outer contour which is shaped and dimensioned, at least in the inlet region towards gaps, so that the printed products form an intersection angle which is defined by an axial projection between the contour of the braking fingers and an adjacent inner surface of a vane or a blade and continuously increases during rotation of the paddle wheel vanes or discs to define effective gaps of continuously decreasing width during rotation of the paddle wheel vanes.

The position of the fingers is adjustable along a predetermined direction by an electrical closed-loop positioning system which receives input signals representative of thickness of products and machine speed and, also emergency control signals to control the position of the fingers with respect to the vanes or blades. Emergency control signals cause withdrawal of the blades to a maximum effective gap position, for example, when tearing-off supply belts; increased braking by the fingers with a narrowed gap at different axial positions can be applied, in order to overcome skewing of incoming or delivered products.

Current device units suffer from an abrupt impact of stripping devices when stripping signatures from delivery units, such as delivery fans. At higher speeds, this sudden impact can cause leading-edge damage, such as the forming of dents. The arrangement of respective fan wheels in a staggered formation has resulted in an acceptable slowdown of signatures, but greater forces are then required to strip the product from the fan wheel pockets. This can, in turn, result in damage of the signature's leading edge. Other attempts to eliminate deficiencies of delivery units resulted in the use of secondary impacts as disclosed in U.S. Pat. No. 5,180,160, the reduction of silicone to increase friction, or the use of narrow pockets.

SUMMARY OF THE INVENTION

Accordingly, given the current state of the art and problems encountered in the technical field, it is an object of the present invention to reduce the deceleration level of printed products below a product damage threshold.

A further object of the present invention is to provide for a deceleration device which is adjustable with respect to product thickness and delivery speed.

A still further object of the present invention is to allow for an easy retrofitting of current folder devices with a deceleration device according to the invention.

According to exemplary embodiments of the present invention, a device for delivering flat products, such as signatures, includes:

a plurality of fan wheels rotatably mounted on a fan wheel shaft in spaced relation to one another in an axial direction, said fan wheels each having a plurality of fan pockets for receiving signatures emerging from a transporting device; and at least one adjustably mounted deceleration device having a curvature for diving between said fan wheels, and for said signatures upon rotation of said fan wheels. In accordance with exemplary embodiments, the at least one deceleration device further comprises an upper portion and a lower portion separated from one another by a slot. Since both portions are separated from each other by a slot, an adjusting device being mounted to connect both portions allows for adjusting the horizontal position of said curvature with respect to said fan pockets.

The curvature can, in exemplary embodiments, be subdivided into three sections; the first one of the sections gradually impacting the signatures, the second one increasing the frictional contact between signatures and pocket surfaces, and in the third section the signatures are stripped from said pockets.

In exemplary embodiments, the lower portion of said deceleration device has a guiding edge for maintaining the position of the signatures' leading edges when conveyed onto a conveyor device.

BRIEF DESCRIPTION OF THE DRAWINGS

Other objects and advantages of the present invention will become apparent on reading the detailed description of a preferred embodiment of the invention in conjunction with the accompanying drawings, wherein.

DETAILED DESCRIPTION OF THE PREFERRED EMBODIMENT

Figure 1:
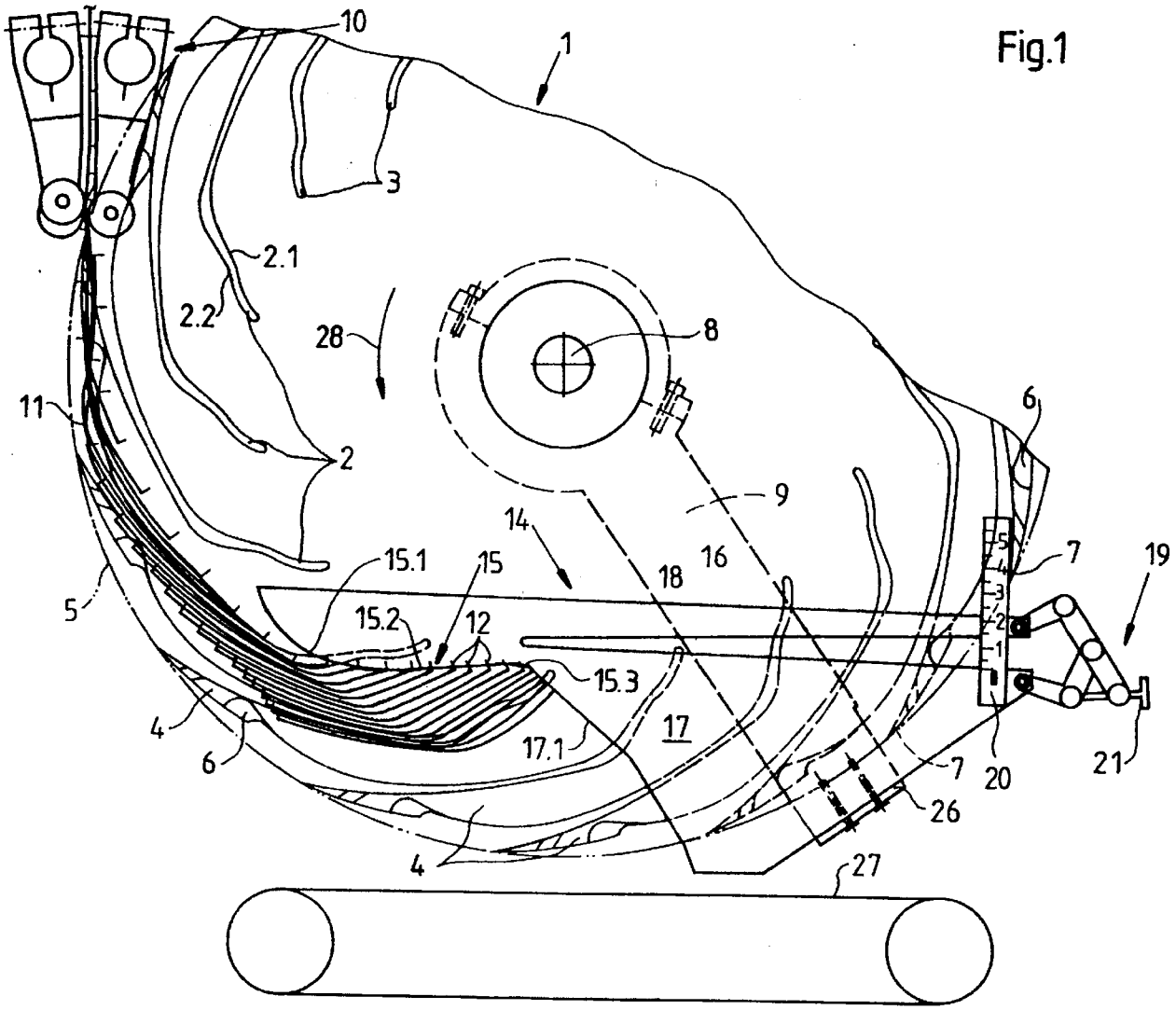
FIG. 1 shows a side view of an exemplary embodiment of an adjustable deceleration device assigned to a fan wheel mounted on a fan wheel shaft.

FIG. 1 shows a fan wheel 1 mounted on a fan wheel shaft 8. A plurality of the fan wheels 1 is mounted in spaced-apart relation on the fan wheel shaft 8 in an axial direction thereof. The fan wheels 1 include fan pockets 2, each having an upper edge 2.1 and a lower edge 2.2 with respect to the direction of rotation of the fan wheel 1. The fan pockets 2 each include pocket bottoms 3 to be smoothly contacted by a leading edge 12 of the signatures 11. On the circumference of the fan wheels 1 a plurality of fan blades 4 is arranged, each of which has a fan blade tip 7 describing an envelope curve 5 upon rotational movement thereof. Each of the fan blades 4 is provided with recesses 6 and a fan blade tip area.

By means of a pair of support brackets 9, a supporting bar 26 is mounted on the fan wheel shaft 8, to which a plurality of deceleration devices 14 is attached. The deceleration devices 14 each have a curvature 15 as well as an upper portion 16 and a lower portion 17 separated from each other by a slit 18. At the open end of the slit an adjusting device 19 is provided for narrowing or broadening the slit 18 between the upper portion 16 and the lower portion 17, thus moving the deceleration device 14 and consequently its curvature 15 into an upward and a downward position. The adjusting device 19 includes two levers which are pivotably mounted and can be actuated by means of an adjusting knob 21. A scale 20 affixed to the lower portion 17 of the deceleration device 14 shows the position of the curvature 15 of the deceleration device 14.

The fan wheels 1 being mounted on said fan wheel shaft 8 receive the signatures 11 from a lead-in module 10. The respective leading edges 12 of the signatures 11 move into respective fan pockets 2 upon rotation of the fan wheels 1. The respective signatures 11 moving into the fan pockets 2, on frictional contact, dissipate kinetic energy to the edges 2.1 and 2.2 of the fan pockets 2. The progression of a signature 11 through an exemplary respective fan pocket 2 is given in detail in FIG. 1.

As is apparent from FIG. 1, the leading edge 12 of the moving signature 11, before reaching the bottom 3 of a pocket 2, is contacted by the curvature 15 of the deceleration device 14 to increase frictional contact between the surfaces of the signature 11 and the lower edge 2.2 of the fan pocket 2. The exemplary curvature 15 can be generally divided into three areas: the first curvature section 15.1 for first gradually contacting the leading edge 12 of a respective signature 11, the second curvature section 15.2 wherein the frictional contact between the surface of the signature 11 and the lower edge 2.2 of the respective fan pocket 2 is increased; and the third curvature section 15.3 for stripping the received signature 11 from the respective fan pocket 2 after it has contacted the bottom 3 of the fan pocket 2. Upon further rotational movement in a counter-clockwise direction as indicated by the arrow 28, the leading edge 12 of the signature 11 moves along the left-hand side edge 17.1 of the lower portion 17 of said deceleration device 14.

The curvature 15 and, accordingly, the sections thereof described above match with a certain degree or amount of deceleration to be imposed on the signatures 11. As signatures 11 of different thicknesses have a different behavior upon decelerating, the deceleration device 14 is adjustable by means of the adjusting device 19 according to individual requirements. The curvature 15 can be brought closer to the lower edge 2.2 of a fan pocket 2 when very thin signatures are decelerated, and the curvature 15 can be raised to a more upward position when signatures 11 of increased thickness are decelerated. Thus, the degree of deceleration of the signatures is adjustable, dependent on the respective signature thickness. In order to provide for a smooth impact of the respective signatures' leading edges 12, the curvature can be set at a shallow angle to avoid any skewing or denting of the signatures 11.

Since the curvature 15 of the deceleration devices 14 is adjustable with the deceleration devices in position, the impact of the signatures 11, having partially entered respective fan pockets 2 on their rotational movement, occurs on the curvature 15 during the last part of the signature travel section through the fan pockets 2, due to the rotational movement of the fan pockets 2. The shape of the curvature 15 of the deceleration device 14 matches the shape of the upper and lower edges 2.1 and 2.2 of the fan pockets 2; this allows for a predictable amount of deceleration of a shingled formation of signatures on a conveyor 27 to be achieved without skewing. Thus, a uniform spacing of the signatures 11 can easily be accomplished, which facilitates the further processing of the signatures 11.

Figure 2:
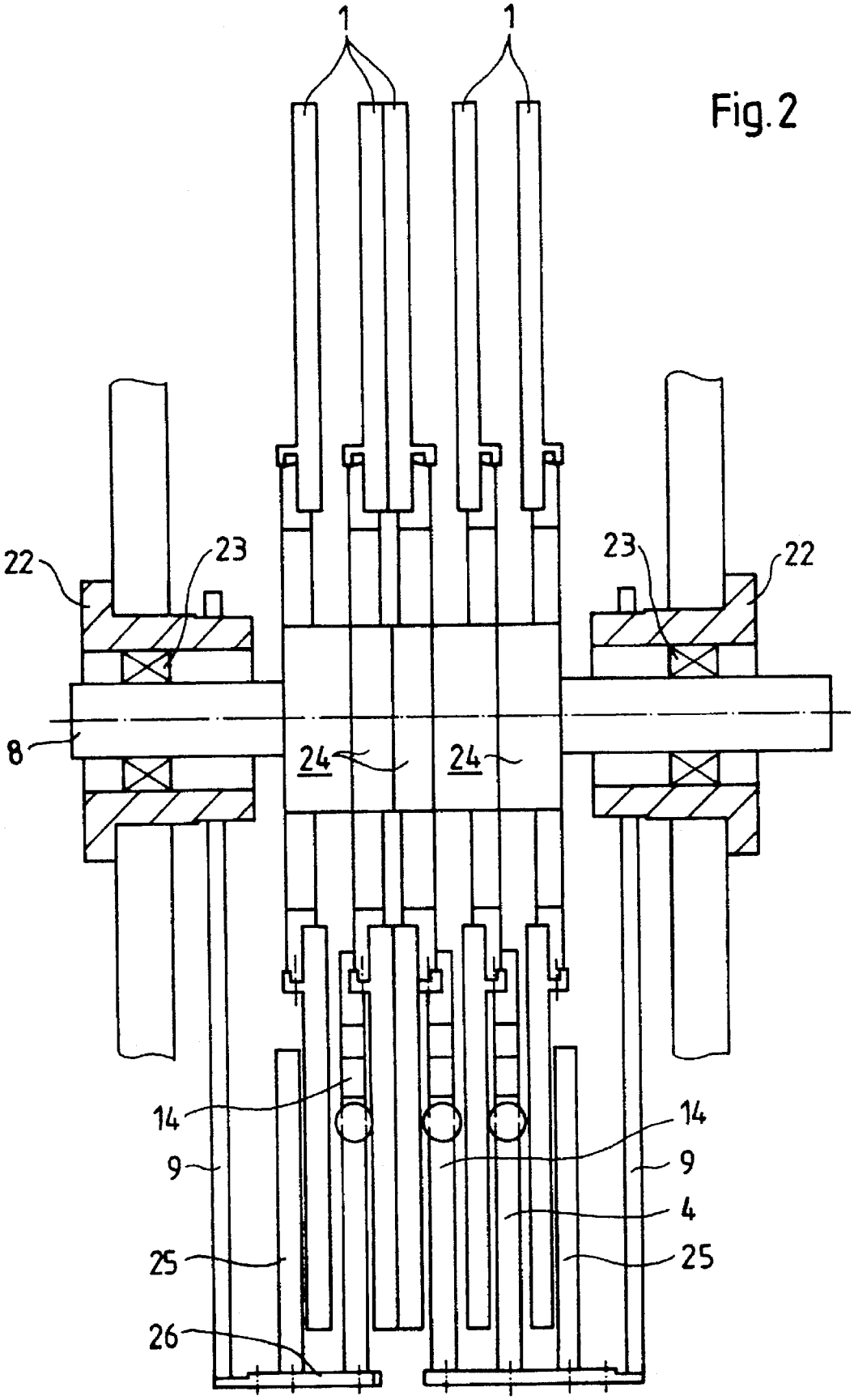
FIG. 2 shows a top view of exemplary deceleration devices mounted between said spaced-apart fan wheels.

FIG. 2 shows a top view of a fan wheel arrangement according to an exemplary embodiment of the present invention.

Referring to FIG. 2, the fan wheel shaft 8 is mounted in bearing strips 23, each of which is received in a hub 22 of a supporting structure, such as a sidewall or the like. Disc-shaped elements are attached to the hubs 22, and support brackets 9 are received in the disc-shaped elements. At the lower end thereof, a supporting bar 26 is mounted, to which conventional fixed strippers 25 as well as deceleration devices 14 are attached. As shown in FIG. 2, the fan wheels 1 are mounted on supporting discs 24 while being spaced from one another on the fan wheel shaft 8. Deceleration devices 14 are mounted in the respective spacings between adjacent fan wheels 1.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. Device for delivering flat printed products, such as signatures, comprising:

a plurality of fan wheels rotatably mounted on a fan wheel shaft in spaced relation to one another in an axial direction, said fan wheels each having a plurality of fan pockets for receiving signatures emerging from a transporting device; and at least one adjustably mounted deceleration device having a curvature for diving between said fan wheels and for providing a deceleratioh of said signatures upon rotation of said fan wheels, said curvature having at least three curvature sections of different curvature, wherein a third of said three curvature sections is used to strip said signatures from said fan pockets.

2. Device according to claim 1, wherein said at least one deceleration device comprises an upper portion and a lower portion.

3. Device according to claim 2, wherein said lower portion of said at least one deceleration device comprises a guiding edge.

4. Device according to claim 1, wherein an adjusting device is assigned to said at least one deceleration device for adjusting a horizontal position of said curvature with respect to said fan pockets.

5. Device according to claim 1, wherein a first of said three curvature sections of said curvature provides for a gradual impact of said signatures.

6. Device according to claim 5, wherein a second of said three curvature sections increases frictional contact between said signatures and a fan pocket edge.

7. Device according to claim 6, wherein said third of said three curvature sections strips said signatures from said fan pockets.

8. Device according to claim 1, wherein a second of said three curvature sections increases frictional contact between said signatures and a fan pocket edge.

9. Device for delivering flat printed products, such as signatures, comprising:

a plurality of fan wheels rotatably mounted on a fan wheel shaft in spaced relation to one another in an axial direction, said fan wheels each having a plurality of fan pockets for receiving signatures emerging from a transporting device; and at least one adjustably mounted deceleration device having a curvature for diving between said fan wheels and for providing a deceleration of said signatures upon rotation of said fan wheels, said curvature further including a curvature section for decelerating said signatures against a surface of said fan pockets to strip said signatures from said fan pockets.

10. Device according to claim 9, wherein said at least one deceleration device comprises an upper portion and a lower portion.

11. Device according to claim 10, wherein said lower portion of said at least one deceleration device comprises a guiding edge.

12. Device according to claim 9, wherein an adjusting device is assigned to said at least one deceleration device for adjusting a horizontal position of said curvature with respect to said fan pockets.

13. Device according to claim 9, wherein said curvature includes at least three curvature sections of different curvature.

14. Device according to claim 13, wherein a first of said three curvature sections of said curvature provides for a gradual impact of said signatures.

15. Device according to claim 14, wherein a second of said three curvature sections increases frictional contact between said signatures and a fan pocket edge.

16. Device according to claim 15, wherein a third of said three curvature sections is used to strip said signatures from said fan pockets.

17. Device according to claim 14, wherein a second of said three curvature sections increases frictional contact between said signatures and a fan pocket edge.

18. Device according to claim 17, wherein a third of said three curvature sections strips said signatures from said fan pockets.

19. Device according to claim 9, wherein a shape of said curvature is matched to a shape of said fan pockets to strip said signatures from said fan pockets.

* * * * *